US006669584B1

(12) United States Patent
Miller

(10) Patent No.: US 6,669,584 B1
(45) Date of Patent: Dec. 30, 2003

(54) BASEBALL BAT WITH SIMULATED SPIRAL HAND GRIP

(76) Inventor: Arthur Miller, 45 Orchard Ct., Woodbury, NY (US) 11797

( * ) Notice: Subject to any disclaimer, the term of this patent is extended or adjusted under 35 U.S.C. 154(b) by 0 days.

(21) Appl. No.: 10/233,548

(22) Filed: Sep. 3, 2002

(51) Int. Cl.[7] ..... A63B 59/06
(52) U.S. Cl. ..... 473/568
(58) Field of Search ..... 473/567, 568

(56) References Cited

U.S. PATENT DOCUMENTS 2,031,161 A * 2/1936 Hamel ..... 473/568
2,086,062 A 7/1937 Bray
3,433,481 A 3/1969 Tanguay
4,546,976 A * 10/1985 Jones ..... 473/566
5,042,805 A * 8/1991 Nakai ..... 473/320
5,071,123 A * 12/1991 Spector ..... 473/307
5,133,551 A * 7/1992 Handy et al. ..... 473/567
5,303,917 A * 4/1994 Uke ..... 473/567
6,254,502 B1 * 7/2001 Becker ..... 473/594

* cited by examiner

*Primary Examiner*—Mark S. Graham
(74) *Attorney, Agent, or Firm*—Myron Amer P.C.

(57) ABSTRACT

A Little League sized baseball bat of nominal cost to manufacture with an adult baseball bat simulated gripping handle providing the appearance of a cost prohibitive spirally wound tape, but consisting actually of an elastomeric sleeve about the gripping handle with spiral grooving, to thusly contribute to the nominal cost, and simulating the appearance of applied tape.

1 Claim, 1 Drawing Sheet

BASEBALL BAT WITH SIMULATED SPIRAL HAND GRIP

The present invention relates generally to an improvement applied to baseball equipment on which, more particularly, the applied improvement is to the baseball bat gripping handle.

EXAMPLES OF THE PRIOR ART

In Little League baseball, for greater play value the baseball bat used is patterned after the adult counterpart, namely a plastic construction material substituted for wood, but what should be a seemingly identical grip-enhancing wrap on the baseball bat grip handle, such as that described and illustrated in U.S. Pat. No. 3,433,481 for "BASEBALL BAT WRAPPINGS" issued to Tanguay on Mar. 18, 1969 is lacking. A guide also not followed is that for a grip-enhancing wrap as is found on golf equipment, as exemplified by U.S. Pat. No. 2,086,062 for VENTILATED HANDLE" issued to Bray on Jul. 6, 1937. The differences noted is undoubtedly because on adult sports equipment, the higher prices and more critical needs during use of the benefit of grip enhancement, warrants the cost of actual application of the wrap to the handle, but this is not so for the less expensive plastic bats used in Little League baseball, and accordingly the sports equipment for the latter in appearance which should have the appearance of adult sports equipment, with due allowance for size, does not have this desirable cognitive sales feature.

Broadly, it is an object of the present invention to provide a Little League-type baseball bat overcoming the foregoing and other shortcomings of the prior art.

More particularly, it is an object to provide a simulated "adult" spirally wound baseball bat grip handle using to advantage shapes characterizing such a winding and achieved without attendant prohibitive cost, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
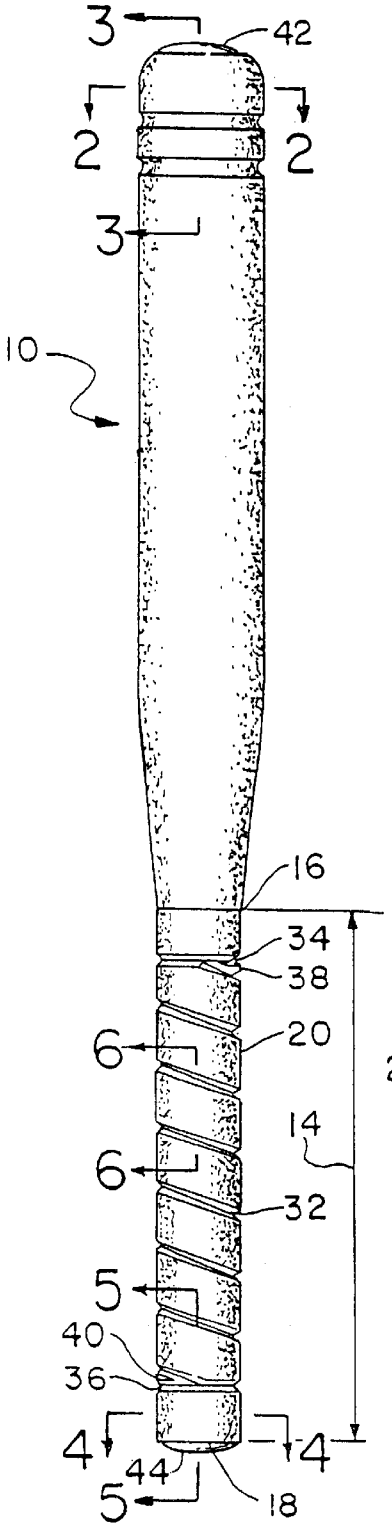
Figure 2:
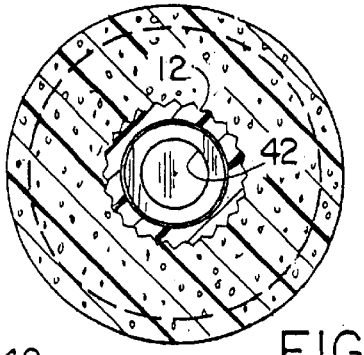
Figure 3:
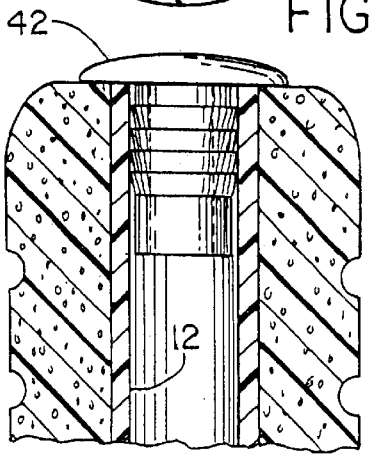
Figure 5:
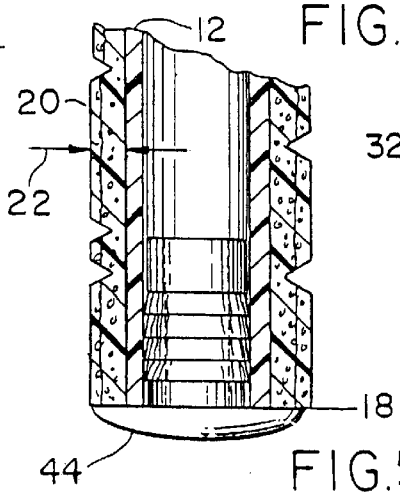
Figure 4:
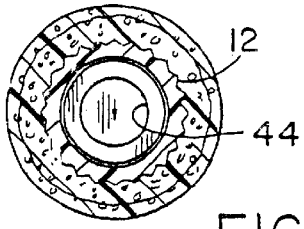
Figure 6:
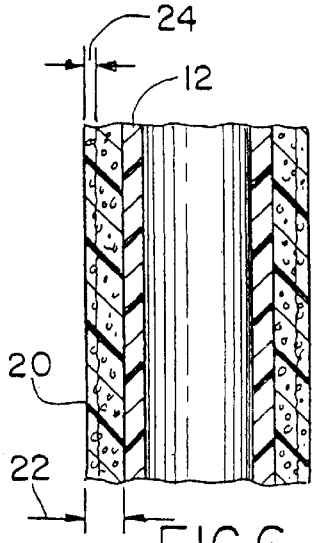
Figure 7:
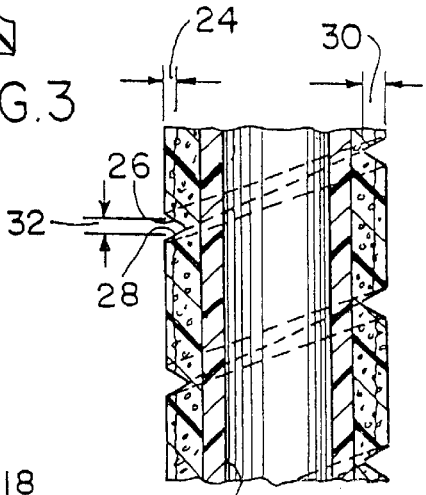

FIG. 1 is a front elevational view of a Little League-type baseball bat having a grip handle according to the present invention; and FIGS. 2, 3, 4, 5, and 6, inclusive, are partial sectional views as taken, respectively, along lines 2—2, 3—3, 4—4, 5—5, and 6—6 of FIG. 1, illustrating structural details of the baseball bat and FIG. 7 is a view similar to FIG. 6 but after grouting of the sleeve shown in FIG. 6.

Little League baseball is, of course, patterned after the adult counterpart, including the equipment used, but differing in the size and construction materials of the equipment. Exemplifying this is the Little League baseball bat 10 of FIG. 1, having a hard plastic cylindrical core 12 whereas the adult counterpart is entirely of wood construction material, as exemplified by U.S. Pat. No. 3,433,481 for "BASEBALL BAT WRAPINGS" issued to Tanguay on Mar. 18, 1969. In the '481 patented bat, the grip handle has a winding to enhance gripping during use, and it would be desirable to embody this also in the bat 10, but for Little League use the gripping function is not that necessary, and also the cost of doing so is prohibitive because of the lesser overall sales price of children's sports equipment.

Underlying the present invention is the recognition that a simulated wrapped gripping handle on the bat 10 provides the desired "adult" appearance of the adult counterpart without the attendant prohibitive expense. To this end, bat 10 has a nominal diameter cylindrically shaped end length portion 14 with a spaced apart upper end 16 and a lower end 18 delimiting therebetween a gripping handle understood to be used in the swinging use of the bat 10.

As an added component, there is provided a cylindrical sleeve 20 of foam construction material of a selected thickness 22 and of a selected first color, e.g., white, disposed in spanning relation between the upper and lower ends 16, 18 and thus in covering relation along the gripping handle 14.

Next, a dye of a selected second color, e.g., black, to provide a contrast to the white color of the foam construction material is added in a controlled absorbed amount to the sleeve 20 to an extent 24 less than the overall sleeve thickness 22, the purpose of which is to carry out the next step of removing an extent of foam construction material from the surface and inwardly of the sleeve 20 to use to advantage a displayed appearance provided by the contrasting black and white colors. The removal of the black surface to a depth just inwardly of the thickness 24 is achieved using a Computer Navigated Control Router or CNC Router surface-modifying device of known construction and operating mode.

The removed foam construction material forms opposite sides 26 and 28 bounding therebetween a nominal depth recess 30 exposing the white color in a continuous spiral configuration, generally designated 32, starting at the upper end 16 and terminating at the lower end 18 which, in practice simulates the appearance of the appearance of an actually wound spiral wrap of an adult baseball bat handle. In this regard, it is known from common experience, that on a bat handle or on a golf club handle, as exemplified by U.S. Pat. No. 2,086,062, the surface-imparting grip of choice is one that is of a wound spiral nature, as distinguished from a parallel nature. Both spiral and parallel wound turns are believed to provide the same non-slip or gripping function, but the spiral is preferred, probably because the fingers gripped about the handle on top of spiral wound turns is in an out-of-phase relationship which correctly or not, is perceived to provide a better grip.

In a spiral wrap, it is recognized that characteristic cognitive features are triangular shapes starting and ending the wrap, and accordingly for display purposes a removed extent of foam construction material forms a cooperating pair of triangular recesses 34, 36 bounding therebetween triangular shapes 38 and 40 each respectively contiguous with the spiral configured shape 32 extending between the respective leading and trailing ends 16, 18 of the gripping handle 14.

Completing the construction of the Little League-type bat 10 is an upper plastic plug 42 and a lower plastic plug 44 each disposed in a friction fit closing off the end openings of the hollow core 12.

While a child's baseball bat with a simulated spiral handle wrap herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A child's baseball bat having a hand-gripped handle comprising a nominal diameter cylindrically shaped length portion at an end of said baseball bat having a spaced apart upper end and a lower end delimiting therebetween a length portion serving as a gripping handle during use of said baseball bat, a cylindrical sleeve of foam construction material of a selected thickness and of a selected first color disposed in spanning relation between said upper and lower ends in covering relation along said gripping handle, a dye of a selected second color in contrasting relation to said first color in an absorbed amount in said cylindrical sleeve to an extent less than said selected thickness thereof, a removed extent of foam construction material from said cylindrical sleeve forming opposite sides bounding therebetween a nominal depth recess exposing said first color in a spiral configuration starting at said upper end and terminating at said lower end, and primarily for display a removed extent of foam construction material forming a cooperating pair of triangular shaped recesses bounding therebetween triangular shapes each respectively contiguous with leading and trailing ends of a spiral configurated shape, whereby a simulated known spiral appearance is imparted to said baseball bat gripping handle.

* * * * *